US011440019B2

(12) United States Patent
Virdis

(10) Patent No.: US 11,440,019 B2
(45) Date of Patent: Sep. 13, 2022

(54) HIGH-THROUGHPUT MILLING DEVICE COMPRISING AN ADJUSTABLE MILLING OPERATION

(71) Applicant: FREWITT FABRIQUE DE MACHINES SA, Granges-Paccot (CH)

(72) Inventor: Antoine Virdis, Ferpicloz (CH)

(73) Assignee: FREWITT FABRIQUE DE MACHINES SA, Granges-Paccot (CH)

( * ) Notice: Subject to any disclaimer, the term of this patent is extended or adjusted under 35 U.S.C. 154(b) by 197 days.

(21) Appl. No.: 16/309,636

(22) PCT Filed: Jun. 23, 2017

(86) PCT No.: PCT/IB2017/053753

§ 371 (c)(1),
(2) Date: Dec. 13, 2018

(87) PCT Pub. No.: WO2018/002786

PCT Pub. Date: Jan. 4, 2018

(65) Prior Publication Data

US 2019/0308199 A1 Oct. 10, 2019

(30) Foreign Application Priority Data

Jun. 28, 2016 (CH) ..... 00820/16

(51) Int. Cl.

| | |
|---|---|
| ***B02C 18/24*** | (2006.01) |
| ***B02C 18/06*** | (2006.01) |
| ***B02C 18/18*** | (2006.01) |

(52) U.S. Cl.
CPC ..... *B02C 18/062* (2013.01); *B02C 18/186* (2013.01); *B02C 18/24* (2013.01)

(58) Field of Classification Search
CPC ..... B02C 18/062; B02C 18/186; B02C 18/24; B02C 4/26; B02C 13/14; B02C 2/10;
(Continued)

(56) References Cited

U.S. PATENT DOCUMENTS 2,947,486 A * 8/1960 Higer ..... E03C 1/2665 241/46.11
3,236,462 A * 2/1966 Stout ..... E03C 1/2665 241/245

(Continued)

OTHER PUBLICATIONS

International Search Report for PCT/IB2017/053753 dated Oct. 2, 2017.
Written Opinion for PCT/IB2017/053753 dated Oct. 2, 2017.

*Primary Examiner* — Faye Francis
(74) *Attorney, Agent, or Firm* — Pearne & Gordon LLP

(57) ABSTRACT

A milling device for implementing a milling operation including a milling unit having a body including a milling chamber that can be filled with a material to be milled, a rotor mounted so as to be able to rotate around a shaft in the body, a screen, and a drive unit controlling the movements of the rotor with respect to the screen during the milling operation. The drive unit is designed to impart an oscillating movement to the rotor around the shaft, the oscillation angle being variable during the milling operation. The milling chamber is configured to direct the product to be milled in a direction substantially parallel to the rotation shaft of the rotor.

13 Claims, 3 Drawing Sheets

(58) Field of Classification Search
CPC ..... B02C 19/0018; B02C 2/047; B02C 13/18; B02C 18/0092; B02C 18/0084; B02C 18/083; E04F 11/1863
See application file for complete search history.

(56) References Cited

U.S. PATENT DOCUMENTS 3,249,310 A * 5/1966 Willems ..... B29B 13/10 241/29
3,591,095 A * 7/1971 Di Stefano ..... B02C 18/0092 241/46.06
4,128,210 A * 12/1978 Brenner ..... E03C 1/2665 241/46.014
4,610,397 A * 9/1986 Fischer ..... B02C 18/062 241/257.1
4,630,780 A * 12/1986 Immel ..... B02C 18/0092 241/46.06
5,330,113 A * 7/1994 Poser ..... B02C 18/062 241/199.12
6,439,487 B1 * 8/2002 Anderson ..... E03C 1/2665 241/46.08
7,866,583 B2 * 1/2011 Jara-Almonte ..... E03C 1/2665 241/DIG. 38
8,500,050 B2 * 8/2013 Ryder ..... E03C 1/2665 241/86.1
9,222,246 B2 * 12/2015 VanAssche ..... B02C 23/00
9,458,613 B2 * 10/2016 Gormley ..... E03C 1/2665
2006/0118668 A1 * 6/2006 Matsumoto ..... B02C 18/062 241/74
2006/0138258 A1 6/2006 Jarvinen
2006/0144977 A1 * 7/2006 Berdal ..... F16D 43/20 241/73
2011/0114775 A1 5/2011 Lefebvre et al.
2013/0119172 A1 * 5/2013 Virdis ..... B02C 4/26 241/27
2014/0021890 A1 * 1/2014 Herrera ..... B02C 18/24 318/375
2019/0126285 A1 * 5/2019 Janetta ..... G10K 11/178

* cited by examiner

HIGH-THROUGHPUT MILLING DEVICE COMPRISING AN ADJUSTABLE MILLING OPERATION

TECHNICAL FIELD

The present invention relates to a milling device that can implement a milling operation allowing the milling parameters to be adjusted and that allows a high throughput of the milled material.

STATE OF THE ART

In conventional oscillating mills, the material to be milled is milled between a rotating rotor and a screen. The desired properties of the comminuted material, such as particle size and particle flow velocity, can be obtained by appropriately selecting the appropriate milling parameters, such as the rotational speed of the rotor and/or the amplitude of oscillation and frequency in the case where the rotor is oscillating. Proper selection of the appropriate milling parameters is also critical to avoid a significant increase in temperature which could be detrimental to the quality of the crushed material. During most milling operations, however, it can be difficult to choose the parameters that are appropriate during the entire milling operation. Indeed, during milling, the material can modify its properties, for example due to the high temperature and/or humidity, which makes the milling parameters insufficient. In order to obtain an acceptable and uniform particle size of the crushed material, it is necessary to modify the milling parameters during the milling operation. Another problem is to obtain a high throughput of the crushed material.

BRIEF SUMMARY OF THE INVENTION

The present invention relates to a milling device for carrying out a milling operation, comprising:

a milling unit including a body comprising a milling chamber, which can be filled with a material to be milled, a rotor rotatably mounted around a shaft in the body, a screen, and a drive unit controlling the movements the rotor with respect to the screen during the milling operation;

wherein the drive unit is designed to impart an oscillation movement to the rotor around the shaft, the oscillation angle being variable during the milling operation; and wherein the milling chamber is configured to direct the product to be milled in a direction substantially parallel to the rotation shaft of the rotor.

The milling device of the invention makes it possible to implement a milling operation in which it is possible to adjust the milling parameters, while allowing a high throughput rate of the crushed material.

BRIEF DESCRIPTION OF THE FIGURES

Examples of implementation of the invention are indicated in the description illustrated by the appended figures in which.

EXAMPLE(S) OF EMBODIMENT

Figure 1:
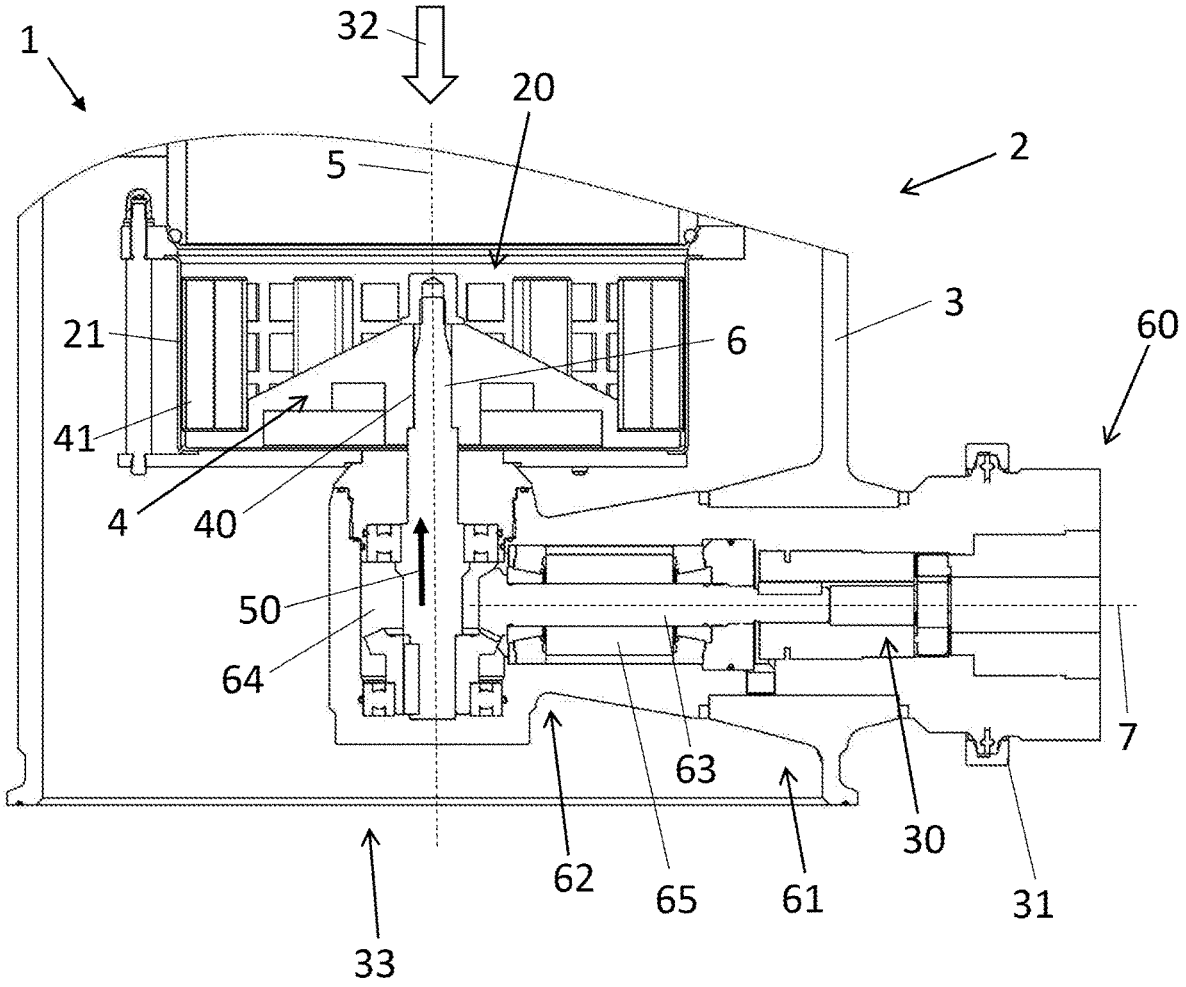
FIG. 1 shows a milling device 1 comprising a rotor and a screen, according to one embodiment.

FIG. 1 shows a milling device 1 for carrying out a milling operation, according to one embodiment. The milling unit 2 comprises a body 3 comprising a milling chamber 20. A rotor 4 is rotatably mounted around a shaft 5 in the body 3. A screen 21 is mounted concentrically around the rotor 4. A drive unit 60 (only partially visible in FIG. 1) can be operatively connected to the milling unit 2 to drive the rotor 4 relative to the screen 21 during the milling operation. According to this arrangement, the rotor 4 is mounted substantially vertically, concentric with the screen 21.

The material to be ground can be introduced into the upper milling chamber 20 via an inlet 32. During the milling operation, the material is crushed by the combined action of the rotor 4 and the screen 21, and the crushed material which has passed through the screen 21 leaves the milling unit 2 through an outlet 33 (from below).

The milling device 1 comprises a transmission element 61 comprising a milling shaft 6 on which the rotor 4 is mounted. The transmission element 61 is configured to transmit the drive of the drive unit 60 to the milling shaft 6.

According to a preferred form, the transmission element 61 comprises a transmission joint 62 for driving the milling shaft 6 via a transmission shaft 63, substantially orthogonal to the milling shaft 6. The milling shaft 6 is mounted in a milling shaft bearing 64 and the transmission shaft 63 is mounted in a transmission bearing 65.

The transmission element 61 can also be configured to drive the rotor 4 directly from the top or the bottom, i.e. to provide a functional connection according to the orientation of the rotation shaft 5 of the rotor 4 (direct transmission).

Advantageously, the transmission element 61 also comprises a connection unit 30 for functionally connecting the milling unit 2 to the drive unit 60, via the transmission element 61. The connection unit 30 is configured to enable the transmission element 61 to be removably connected to the drive unit 60. The connection of the transmission element 61 to the drive unit 60 may include a "tri-clamp" type collar or other suitable quick connect system.

When the milling unit 2 is connected to the drive unit 60, via the transmission element 61 and the connection unit 30, the drive unit 60 drives the milling shaft 6 in rotation around the shaft 5. The movements of the rotor 4 with respect to the screen 21 can be controlled so as to carry out the milling operation, i.e. to allow the splitting of the material to be crushed by the combined action of the rotor 4 and the screen 21, according to desired milling specifications.

The milling chamber 2, configured so that the material flows from top to bottom (between the inlet 32 and the outlet 33) in a direction substantially parallel to the rotation shaft 5 of the rotor 4 makes it possible to take advantage of gravity and increase the flow rate of the ground material as compared to a device in which the rotor and the screen are oriented horizontally. The flow rate of the milled material is also increased by the larger area of the concentric screen 21 as compared to to a screen placed under a rotor rotating along a horizontally oriented axis.

In one embodiment, the connection unit 30 includes an adapter module 31 configured to match the characteristics of the drive unit 60 to the needs of the milling unit 2 operably connected to the drive unit 60. It is thus possible to functionally connect different milling units 2 depending on the milling process that one wishes to carry out. One advantage of the connection unit 30 is that a single drive unit 60 can be used for a plurality of milling chambers 2, reducing the costs of the equipment.

The throughput rate of the material to be crushed entering the milling chamber 2 can be regulated by the addition of a metering system (not shown). The flow rate can also be changed by driving the material through an air flow (not shown).

A protective air flow 50 may be injected along the rotor shaft 5, directed towards the rotor 4 so as to prevent infiltration of the material to be crushed into the transmission element 61 and to avoid a risk of overheating of the transmission element 61 and of the rotor 4.

The drive unit 60 and/or the transmission element 61 may incorporate a cooling system to enable heat sensitive materials to be processed.

The milling device 1 can be adapted for cryogenic milling or vacuum milling. The milling device 1 can be used under an inert atmosphere to make it possible to treat explosive products.

Figure 2:
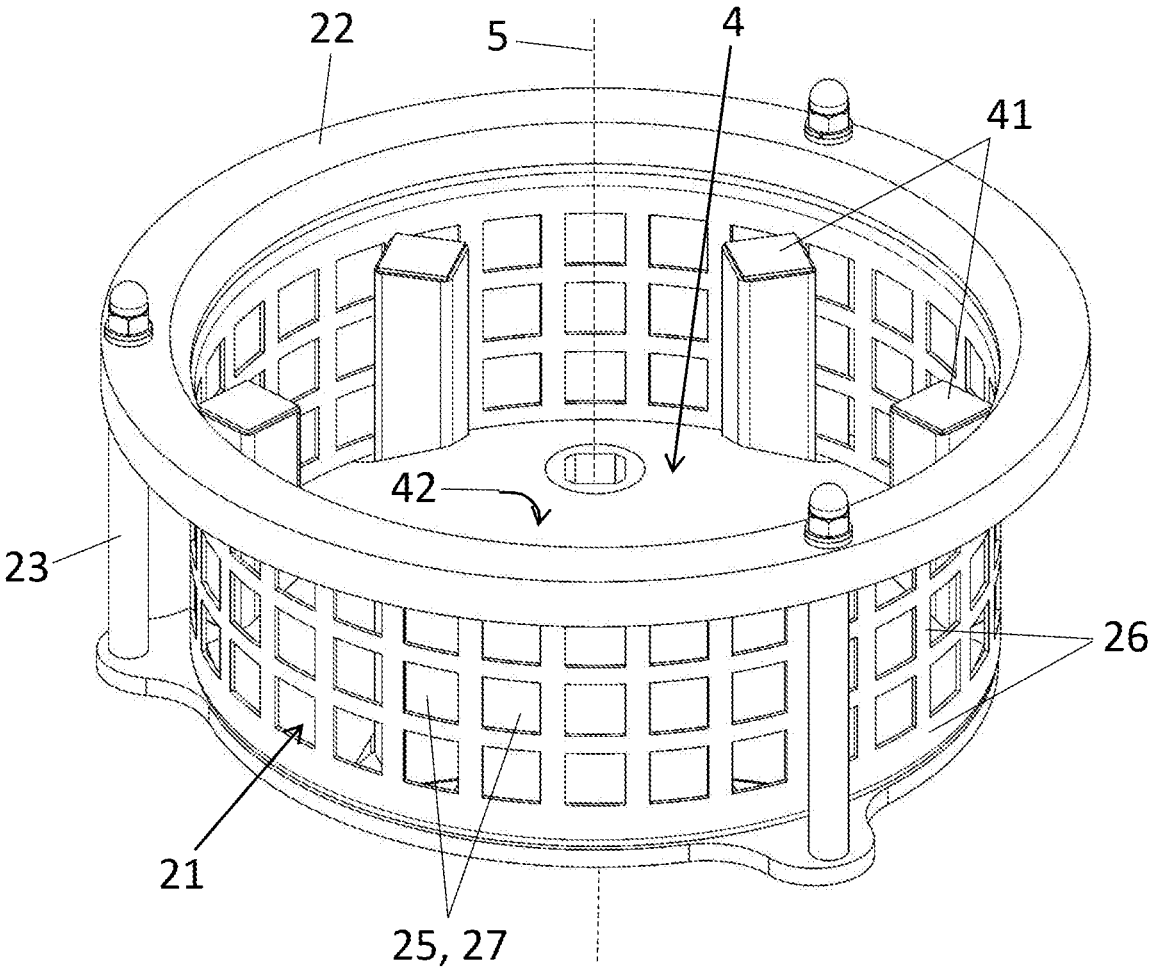
FIG. 2 shows a perspective view of the screen.

FIG. 2 shows a perspective view of the screen 21, according to one embodiment. The screen 21 is cylindrical and can be mounted in the body 3 of the milling chamber 2 concentrically to the rotation shaft 5 of the rotor 4. In the illustrated example, the screen 21 is mounted between two support rings 22 held together by screws 23. The lower support ring 22 comprises a screen bearing 24 for mounting the screen 21 on the milling shaft bearing 64.

The screen 21 may consist of a filtering portion 25 and of a support portion 26. The support portion 26 is provided with large openings 27 through which the milled material passes through the filter portion 25 during the milling operation. The support portion 26 may consist of a thick and solid element, ensuring a certain rigidity to the screen 21. The filtering portion 25 may be composed of thin apertures to facilitate a fluid flow rate of the materials. The screen 21 may be made of a metal alloy material. Preferably, the filter portion 25 and the support portion 26 are integrally formed so that the screen 21 is formed integrally. Such a screen 21 makes it possible, as opposed to screens consisting of several bonded or welded elements, to prevent the powdery materials from intruding into cavities, between the filtering part 25 and the support part 26. The cylindrical screen 21 allows a larger milling surface.

The screen 21 may be coupled to a vibration generator (not shown) so as to facilitate the flow of the crushed material through the screen 21. The effect of the vibration prevents the material from agglomerating in the openings of the screen 21 during the milling operation, thus allowing a continuous flow of the milled material, without human intervention. Indeed, the vibrations generated by the vibration generator is transmitted to the filter portion 25 of the screen 21 in a very efficient manner. This causes an acceleration of the circulation of the crushed material, in particular to avoid the risk of stagnation of powdery materials. In this case, the screen 21 formed in one piece is advantageous since the latter is devoid of bonding or welding areas and does not risk being weakened by the vibrations exerted by the vibration generator.

Figure 3:
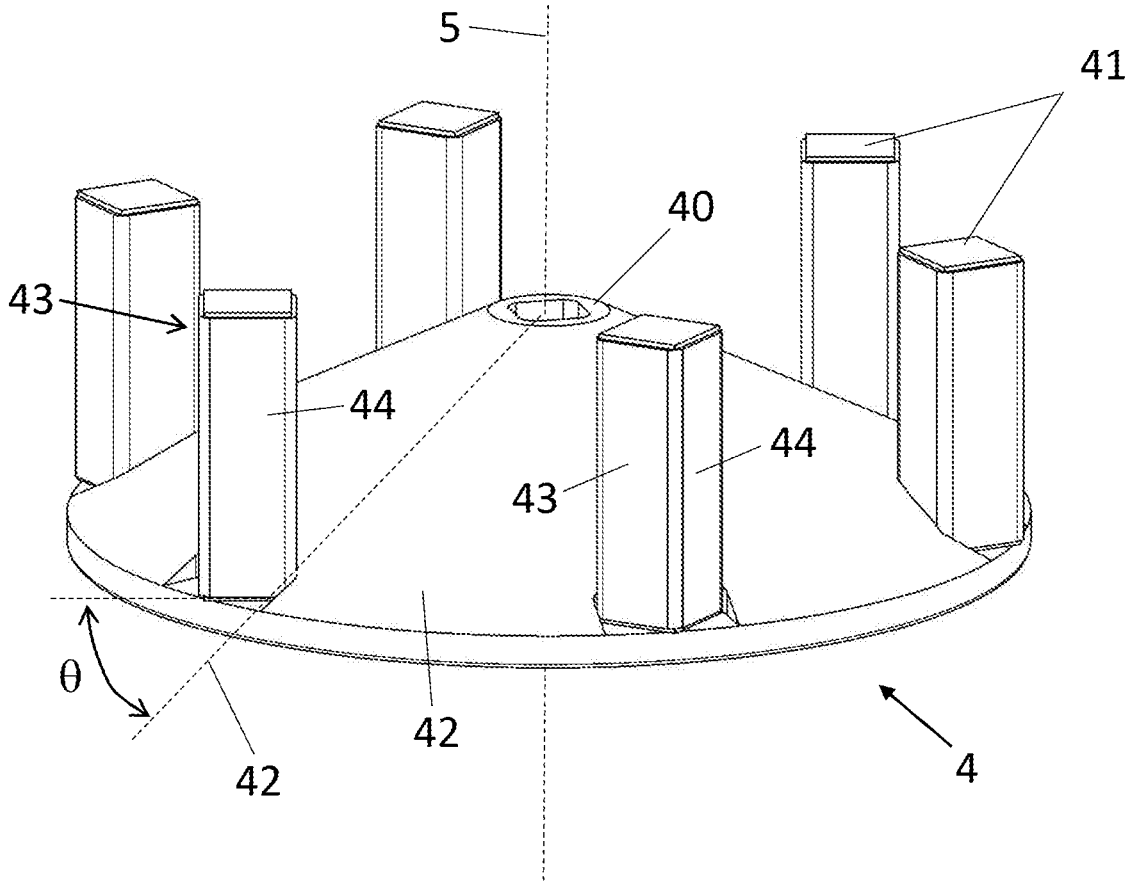
FIG. 3 shows a detailed view of the rotor, according to one embodiment.

A detailed view of the rotor 4 is shown in FIG. 3, according to one embodiment. The rotor 4 comprises a bearing 40 arranged to be mounted on a milling shaft 6 parallel to the shaft 5. A plurality of blades 41 are arranged concentrically with the rotation shaft 5 of the rotor 4 and substantially parallel to this shaft 5. The rotor 4 comprises a disc 42 extending radially from the bearing 40. The blades are mounted at the periphery of the disk 42. In the illustrated example, the rotor comprises five blades 41 distributed angularly equidistant. However, a different number of blades 41 and a different arrangement are also possible depending on the needs of the milling process.

Preferably, the disc 42 occupies substantially the entire surface under the screen 21 so as to direct the material to be ground on the sides, i.e. passing through the screen 21.

Advantageously, the disc 42 has a frustoconical shape so that the material to be ground is guided towards the milling zone, i.e. towards the blades 41 and the screen 21. In this way, the frustoconical shape of the disc 42 prevents the material to be ground from lying too long (in other words, avoids a retention zone of the material to be ground) in the region between the rotor bearing 40 and the blades 41.

In one embodiment, the movement of the rotor 4 relative to the screen 21 comprises a rotation motion around the shaft 5. The rotational speed of the rotor 4 can be varied, for example, according to the milling method, the type of rotor 4 and/or of screen 21 and the material to be ground. The rotational speed of the rotor 4 can also be varied during the milling process.

The movement of the rotor 4 relative to the screen 21 also comprises an oscillation movement with an oscillation frequency that can be varied during the milling operation. In particular, the rotor 4 can be pivoted in one direction or the other with respect to the screen 21. The oscillation movement can occur with a predetermined oscillation angle (i.e. with a predetermined oscillation amplitude).

The predetermined oscillation angle can have a value between 0 and 360°. The predetermined oscillation angle may also correspond to several complete turns in the same direction.

The rotor can oscillate with an oscillation frequency between 0 and 4 Hz. The oscillation frequency can be varied during the milling operation. In a variant embodiment, a vibratory movement of the rotor 4 can be obtained when the latter is oscillated with an oscillation frequency of less than about 2°.

The movement of the rotor 4 relative to the screen 21 can also comprise an offset of the oscillation angle during the milling operation, for example at each oscillation of the oscillation movement of the rotor 4. Such an offset of the oscillation angle means that the angular position of the rotor 4 is shifted by the offset value of the oscillation angle after completion of one oscillation cycle (one oscillation motion). The offset of the oscillation angle can be between 0 and 90°. The offset of the oscillation angle can be varied during the milling operation.

According to one variant, not illustrated, the drive unit 60 may comprise a controller configured so as to determine milling parameters on the basis of signals supplied by a sensor. The parameters determined by the controller can then be used to control the drive unit 60 so as to drive the rotor 4 according to the determined parameters. In this way, the milling operation can be optimized depending on the material to be ground and the milling conditions, which are measured by the sensor. The movements of the rotor 4 can therefore be controlled in real time during the milling operation.

The movements of the rotor 4 relative to the screen 21 described above can be adjusted according to the milling parameters determined by the controller on the basis of the signals supplied by the sensor.

In the example of FIG. 3, the blades 41 are illustrated with a substantially square section. However, other configurations of blades 41 are also possible depending on the milling process or processes that one wishes to perform.

According to a non-illustrated embodiment, a first longitudinal face 43 of the blade 41 has a profile which differs from a second longitudinal face 44 opposite to the first face 43. In this configuration, when the rotor 4 rotates in one direction, one of the first or second face 43, 44 corresponds to the leading edge, i.e. the side of the blade 41 which faces the material during the rotation of the rotor 4. When the rotor 4 rotates in the opposite direction, the other face 44, 43 corresponds to the leading edge. In this way, it is possible to carry out two different milling processes according to the direction of rotation of the rotor 4.

According to another embodiment, the blades 41 are configured to exert a thrust of the material towards the screen 21. This type of configuration of the blades 41 is particularly suitable when the rotor rotates at low speed, for example, when the rotor speed 4 is between 0 and 200 rpm. An example of such a configuration is shown in FIG. 3, in which the blades 41 of substantially square section are arranged with the faces 43, 44 forming an angle θ relative to a radius 45 of the rotor 4. Such a configuration of the blades 41 has the effect that the ground material is pushed towards the screen 21 by the inclination of the faces 43, 44 relative to the screen 21. The angle θ may vary between 10° and 80°, but is preferably between 40° and 60°. It will be understood, however, that the blades may be arranged with one of the faces substantially parallel to the screen 21, i.e. with an angle θ substantially zero or any other angle θ between 0° and 10° and between 80° and 90°. The speed of the rotor 4 can also be greater than 200 rpm.

REFERENCE NUMBERS USED IN THE FIGURES

1 milling device
2 milling unit
20 milling chamber
21 screen
22 support ring
23 screw
25 filtering part
26 supporting part
27 opening
3 body
30 connection unit
31 adapter module
32 inlet
33 outlet
4 rotor
40 rotor bearing
41 blade
42 disk
43 first face
44 second face
45 radius
5 shaft
50 protective air flow
6 milling shaft
60 drive unit
61 transmission element
62 transmission joint
63 transmission shaft
64 milling shaft bearing
65 transmission bearing
7 drive shaft

The invention claimed is:

1. A milling device for carrying out a milling operation, comprising:

a milling unit including a body comprising a milling chamber which can be filled with material to be milled, a rotor rotatably mounted around a rotation axis in the body, a plurality of blades, a screen, and a drive unit controlling the movements of the rotor with respect to the screen during the milling operation;

wherein the drive unit is designed to impart an oscillation movement to the rotor around the rotation axis, an oscillation angle being variable during the milling operation;

wherein the milling chamber is configured to direct the product to be milled in a direction parallel to the rotation axis of the rotor;

wherein the milling device further comprises a transmission element comprising a milling shaft on which is mounted the rotor, the transmission element being arranged for transmitting the drive of the drive unit to the milling shaft; the rotor being mounted vertically, concentric with the screen; and wherein the rotor comprises a bearing arranged to be mounted on the milling shaft parallel to the rotation axis of the rotor and a disk extending radially from the bearing; the disk being frustoconical in shape so as to guide the material to be milled towards the screen.

2. The milling device of claim 1, wherein the screen is cylindrical and concentric with the rotation axis of the rotor.

3. The milling device according to claim 1, wherein the rotor comprises the plurality of blades, said blades being concentric with parallel to said rotation axis, and wherein the frustoconical shape of the disk guides the material to be milled towards the blades.

4. The milling device according to claim 3, wherein a first longitudinal face of a blade of the plurality of blades has a profile which differs from a second longitudinal face opposite the first face, so that two milling processes can be performed according to the direction of rotation of the rotor.

5. The milling device according to claim 3, wherein the blades are configured so as to exert thrust of the material to be ground towards the screen.

6. The milling device according to claim 1, wherein the transmission element comprises a transmission joint for driving the milling shaft through a transmission shaft, orthogonal to the milling shaft.

7. The milling device of claim 1, further comprising a connection unit configured for connecting the transmission element to the drive unit in a removable and operable manner.

8. The milling device according to claim 7, wherein the connection unit comprises an adapter module configured to match the characteristics of the drive unit to the needs of the milling unit operatively connected to the drive unit.

9. The milling device according to claim 1, wherein the oscillation movement comprises an oscillation frequency which can be varied during the milling operation.

10. The milling device according to claim 1, wherein the oscillation angle can be offset during the milling operation.

11. The milling device according to claim 1, wherein the rotational speed of the rotor can be varied during the milling operation.

12. A milling device for carrying out a milling operation, comprising:

a milling unit including a body comprising a milling chamber which can be filled with material to be milled, a rotor rotatably mounted around a rotation axis in the body, a screen, and a drive unit controlling the movements of the rotor with respect to the screen during the milling operation;

wherein the drive unit is designed to impart an oscillation movement to the rotor around the rotation axis, an oscillation angle being variable during the milling operation;

wherein the milling chamber is configured to direct the product to be milled in a direction parallel to the rotation axis of the rotor;

wherein the milling device further comprises a transmission element comprising a milling shaft on which is mounted the rotor, the transmission element being arranged for transmitting the drive of the drive unit to the milling shaft; the rotor being mounted vertically, concentric with the screen;

wherein the rotor comprises a bearing arranged to be mounted on the milling shaft parallel to the rotation axis of the rotor and a disk extending radially from the bearing, the disk being frustoconical in shape so as to guide the material to be milled towards the screen; and wherein the rotor comprises a plurality of blades concentric with the rotation axis and parallel to said rotation axis, and wherein the frustoconical shape of the disk guides the material to be milled towards the blades.

13. A milling device for carrying out a milling operation, comprising:

a milling unit including a body comprising a milling chamber which can be filled with material to be milled, a rotor rotatably mounted around a rotation axis in the body, a screen, and a drive unit controlling the movements of the rotor with respect to the screen during the milling operation;

wherein the drive unit is designed to impart an oscillation movement to the rotor around the rotation axis, an oscillation angle being variable during the milling operation;

wherein the milling chamber is configured to direct the product to be milled in a direction parallel to the rotation axis of the rotor;

wherein the milling device further comprises a transmission element comprising a milling shaft on which is mounted the rotor, the transmission element being arranged for transmitting the drive of the drive unit to the milling shaft; the rotor being mounted vertically, concentric with the screen;

wherein the rotor comprises a bearing arranged to be mounted on the milling shaft parallel to the rotation axis of the rotor and a disk extending radially from the bearing, the disk being frustoconical in shape so as to guide the material to be milled towards the screen; and wherein the rotor comprises a plurality of blades concentric with the rotation axis, parallel to said rotation axis and mounted at the periphery of the disk, and wherein the frustoconical shape of the disk guides the material to be milled towards the blades.

* * * * *